US006782216B2

(12) United States Patent
Suzuki

(10) Patent No.: US 6,782,216 B2
(45) Date of Patent: Aug. 24, 2004

(54) IMAGE RECORDING APPARATUS WITH MEANS FOR SHUT OFF OF ELECTRIC POWER SUPPLY TO FIRST COIL IN ACCORDANCE WITH TEMPERATURE OF SECOND INDUCTION HEAT GENERATING MEMBER

(75) Inventor: Hitoshi Suzuki, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/253,921

(22) Filed: Sep. 25, 2002

(65) Prior Publication Data

US 2003/0068169 A1 Apr. 10, 2003

(30) Foreign Application Priority Data

Sep. 25, 2001 (JP) ..... 2001/290924

(51) Int. Cl.[7] ..... G03G 15/20
(52) U.S. Cl. ..... 399/69; 399/328; 219/619
(58) Field of Search ..... 219/216, 619; 399/67, 69, 328, 330, 333, 334

(56) References Cited

U.S. PATENT DOCUMENTS

| | | | | |
|---|---|---|---|---|
| 5,084,736 A | | 1/1992 | Suzuki et al. | 355/271 |
| 5,168,290 A | | 12/1992 | Tanaka et al. | 346/134 |
| 5,239,347 A | | 8/1993 | Onodera et al. | 355/274 |
| 5,321,486 A | | 6/1994 | Nanbu et al. | 355/311 |
| 5,464,964 A | | 11/1995 | Okuda et al. | 219/497 |
| 5,534,987 A | | 7/1996 | Ohtsuka et al. | 355/285 |
| 5,555,082 A | | 9/1996 | Tanaka et al. | 355/309 |
| 5,676,363 A | | 10/1997 | Kishida et al. | 371/10.01 |
| 5,738,453 A | | 4/1998 | Tsuburaya et al. | 400/624 |
| 5,747,774 A | | 5/1998 | Suzuki et al. | 219/216 |
| 5,994,671 A | | 11/1999 | Suzuki et al. | 219/216 |
| 6,320,168 B1 | * | 11/2001 | Kimata et al. | 219/619 |
| 6,373,036 B2 | | 4/2002 | Suzuki | 219/619 |

FOREIGN PATENT DOCUMENTS

| | | |
|---|---|---|
| JP | 51-109736 | 9/1976 |

* cited by examiner

*Primary Examiner*—Hoang Ngo
(74) *Attorney, Agent, or Firm*—Fitzpatrick, Cella, Harper & Scinto

(57) ABSTRACT

A fixing device includes a first coil for generating a magnetic field; a first heating medium for fixing an unfixed toner image on a recording material by heat, the first heating medium having an electroconductive layer which generates heat by eddy current produced by the magnetic field formed by the current through the first coil; a second coil, electrically connected with the first coil, for generating a magnetic field; a second heating medium having an electroconductive layer which generates heat by eddy current produced by the magnetic field formed by the current through the first coil, wherein a temperature of the second heating medium is lower than that of a temperature of the first heating medium in operation.

11 Claims, 8 Drawing Sheets

IMAGE RECORDING APPARATUS WITH MEANS FOR SHUT OFF OF ELECTRIC POWER SUPPLY TO FIRST COIL IN ACCORDANCE WITH TEMPERATURE OF SECOND INDUCTION HEAT GENERATING MEMBER

FIELD OF THE INVENTION AND RELATED ART

The present invention relates to a fixing device for melting and fixing a toner image on a transfer material in an image forming apparatus and to an image forming apparatus using the same.

The present invention is more particularly related to a heating device comprising a heating medium of electroconductive member, magnetic field generating means for generating induced current in said heating medium and a voltage source for actuating the magnetic field generating means, wherein a developer is fixed on the recording material by induction heating of the heating medium, and to an image forming apparatus using the same.

The image forming apparatus of an electrophotographic type normally comprises a fixing device which fuses and fixes toner which comprises resin material, magnetic member, coloring material or the like and which is electrostatically attracted on a transfer material by nipping and feeding such a transfer material through a nip formed between rotating heating means (roller, endless belt member or the like) and pressing weans (roller, endless bolt member or the like).

In one type of such fixing devices, the heating means comprises an excitation coil and an electroconductive layer, wherein a magnetic flux generated by the excitation coil produces eddy current in the electroconductive layer provided inside the fixing roller (fixing member), by which heat is generated by joule heat, as disclosed in Japanese Laid-Open Utility Model Application Sho 51-109736. With this method, the heat generating source can be disposed very closely to the toner, and therefore, the time required for the temperature of the surface of the fixing roller to reach the proper fixing temperature upon the start of the fixing device can be shortened as compared with a conventional heating roller type using a halogen lamp. In addition, the heat transfer path from the heat generating source to the toner is short and simple, and therefore, the heat efficiency is high.

As regards a safety apparatus for the fixing device, a temperature fuse or a thermostat is mounted. Conventionally, the temperature fuse and/or the thermostat are directly contacted, but doing so damages the surface of the fixing member with the result of shortened service life. For this reason, non-contact mounting is desired. There is a method in which they are disposed out of contact from the fixing member, and the temperature is detected thereby. With this method, the temperature sensing response is slow in consideration of speedy temperature rise provided by the self-heat-generation of the fixing member. To obviate this problem, selection of a high precision temperature fuse, thermostat or the like is difficult. It is desirable that temperature of a portion outside the fixing member is detected by increase and decrease of the current flowing through the coil, so that abnormality such as excessive temperature rise of the fixing member is detected. Japanese Patent Application Hei 9 1978521 discloses a coil in the fixing roller is projected to the outside, and the projection is disposed so as to be influenced by the magnetic field generated by a coil.

However, with this structure, the ambient temperature around the temperature detection member becomes very high because of the heat radiation from the fixing member and the heat generation of the coil per se. Therefore, there arises a problem that excessive temperature rise is discriminated even when the temperature of the fixing member is lower than the limit temperature since the temperature detection member detects the temperature of the fixing member added with the temperature provided by the heat generation of the coil per se.

SUMMARY OF THE INVENTION

Accordingly, it is a principal object of the present Invention to provide a fixing device and an image forming apparatus wherein a coil and a heat generating element having a small heat generation, so that excessive temperature rise of the fixing member is detected correctly.

According to an aspect of the present invention, there is provided a fixing device comprising a first coil for generating a magnetic field; a first heating medium for fixing an unfixed toner image on a recording material by heat, said first heating medium having an electroconductive layer which generates heat by eddy current produced by the magnetic field formed by the current through the first coil; a second coil, electrically connected with said first coil, for generating a magnetic field; a second heating medium having an electroconductive layer which generates heat by eddy current produced by the magnetic field formed by the current through the first coil, wherein a temperature of said second heating medium is lower than that of a temperature of said first heating medium in operation.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 10 FIG. 9 is an equivalent circuit diagram of a heating device according to a third embodiment of the present invention.

DESCRIPTION OF THE PREFERRED EMBODIMENT

Figure 1:
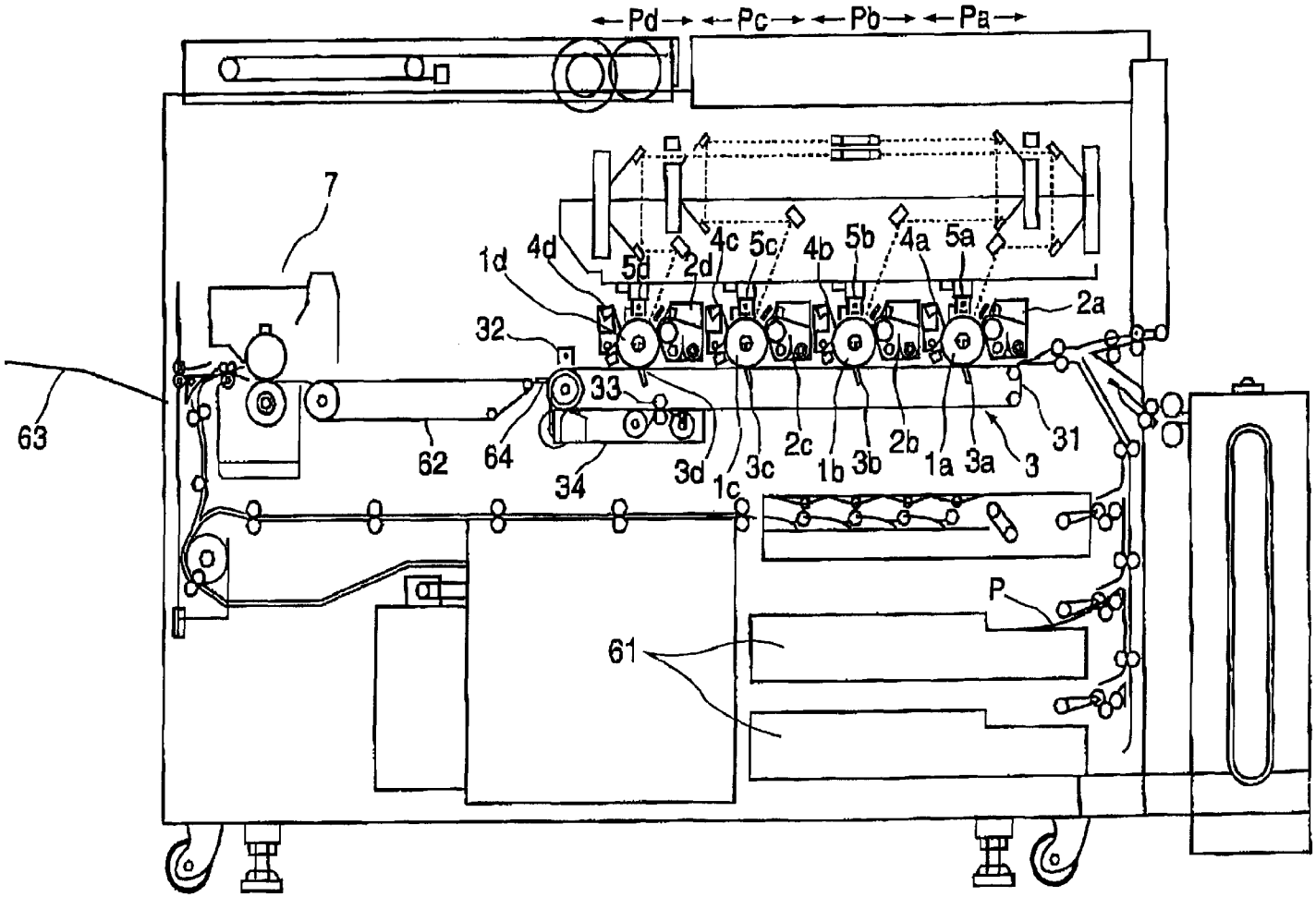
FIG. 1 shows a general arrangement of an image forming apparatus according to an embodiment of the present invention.

Referring to FIG. 1, the description will be made as to process operations in the image formation.

FIG. 1 is a schematic sectional view illustrating a general arrangement of a 4-drum laser beam printer (printer) having a plurality of light scanning means, as an exemplary image forming apparatus according to embodiment of the present invention.

As shown in FIG. 1, the printer of this embodiment comprises four image formation stations (image forming means) each including an electrophotographic photosensitive member (photosensitive drum) which is a latent image bearing member (photosensitive drum), a developing device or the like therearound. The image formed on the photosensitive drum in the image formation station is transferred onto a recording material (paper or the like) carried on feeding means and passed adjacent the photosensitive drum.

Such image formation stations Pa, Pb, Pc, Pd function to form magenta, cyan, yellow and black images, respectively and include photosensitive drums 1*a*, 1*b*, 1*c*, 1*d*, respectively. The photosensitive drum is rotatable in the direction indicated by an arrow Around the photosensitive drums 1*a*, 1*b*, 1*c*, 1*d*, there are provided chargers 5*a*, 5*b*, 5*c*, 5*d* for electrically charging a surface of the photosensitive drum, developing devices 2*a*, 2*b*, 2*c*, 2*d* for developing image information provided by charging and image exposure, and cleaners 4*a*, 4*b*, 4*c*, 4*d* for removing residual toner remaining on the photosensitive drum. Respectively, in the order named with respect to the rotational direction of the photosensitive member. Below the photosensitive drum, there is provided a transfer portion 3 for transferring the toner image from the photosensitive drum onto the recording material. The transfer portion 3 has a transfer belt 31 which is a common recording material feeding means for all the image formation stations and has transfer charger 3*a*, 3*b*, 3*c*, 3*d* for the respective stations.

In such a printer, paper P supplied from a sheet feeding cassette 61 (recording material supplying means) shown in FIG. 1, is supported and carried on the transfer belt 31 to the image formation stations to receive the toner images formed on the respective photosensitive drums. After completion of the transfer step, the paper P is separated from the transfer belt 31, and is red on a conveyer belt 62 (separation) to a fixing device 5.

The fixing device 7 will be described.

Figure 2:
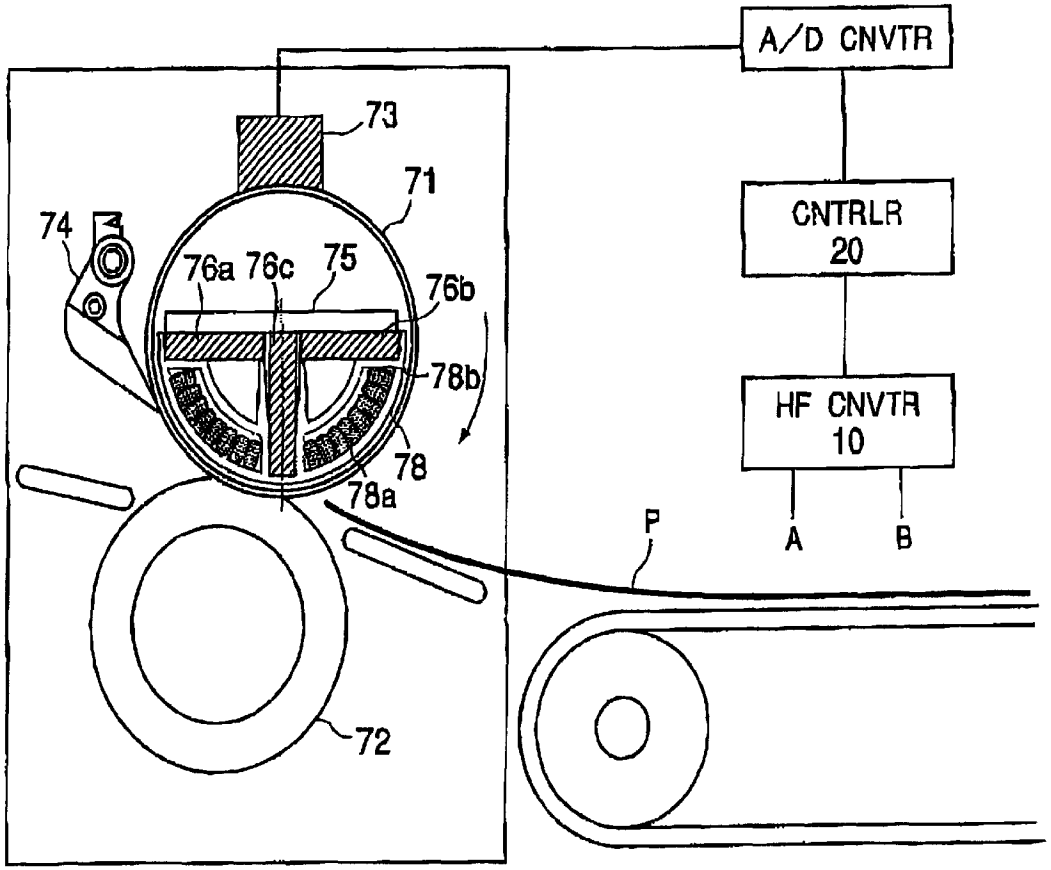
FIG. 2 shows a general arrangement of an image fixing device according to an embodiment of the present invention.

FIG. 2 is a sectional view of a fixing device according to an embodiment of the present invention.

A fixing roller 71 (first heating medium) includes a core metal cylinder of steel having an outer diameter of 32 mm and a thickness of 0.7 mm, and a layer of P!! FE or PFA, for example thereon to enhance a parting property of the fixing roller 71, the layer having a thickness of 1050$\mu$. The material of the fixing roller may be a magnetic material (magnetic metal) such as magnetic stainless steel which has a relatively high magnetic permeability and has a proper resistivity. In addition, nonmagnetic material such as metal having an electroconductivity is usable if the material is sufficiently thinned.

A pressing roller 72 (pressing member or back-up roller) includes a core metal of steel having an outer diameter of 20 mm, a silicone rubber layer having a thickness of 5 mm thereon, and a layer of PTFE, PEA or the like for enhancing a parting property of the surface, the layer having a thickness of 1050$\mu$, similarly to the fixing roller 71.

The fixing roller 71 and the pressing roller 72 are rotatable supported, and the fixing roller 1 is rotated by driving means. The pressing roller 72 is press-contacted to the surface of the fixing roller 71, and is rotated by the fixing roller 71 through frictional force at the press-contact portion (nip), The pressing roller 72 is pressed toward the rotational axis of the fixing roller 71 by springs or the like (not shown).

A temperature sensor 73 (temperature detection member) is disposed contacted to a surface of the fixing roller 71 and A/D-converts a voltage which is a detection signal (output) of the temperature sensor 73. The electric power supply to the excitation coil 78*a* is increased or decreased under the control of the controller portion 20 in accordance with the output of the temperature sensor 73 such that surface temperature of the fixing roller 71 is maintained at a constant level (automatic control).

The detailed description will be made as to the coil unit 78.

Figure 3:
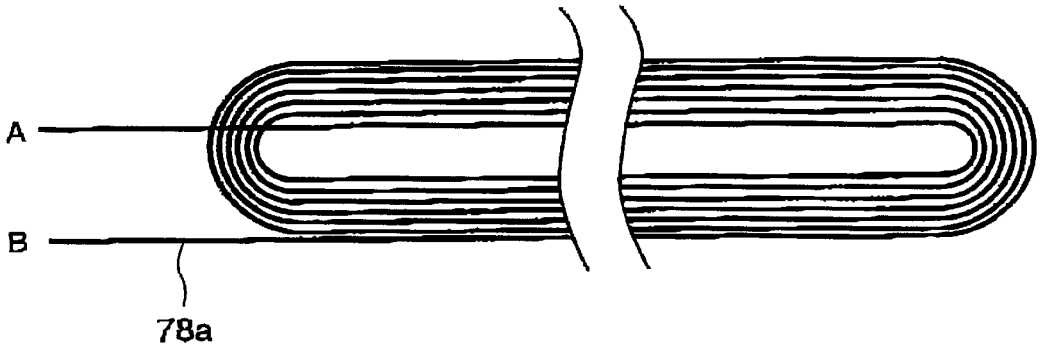
FIG. 3 illustrates winding of an excitation coil.
Figure 4:
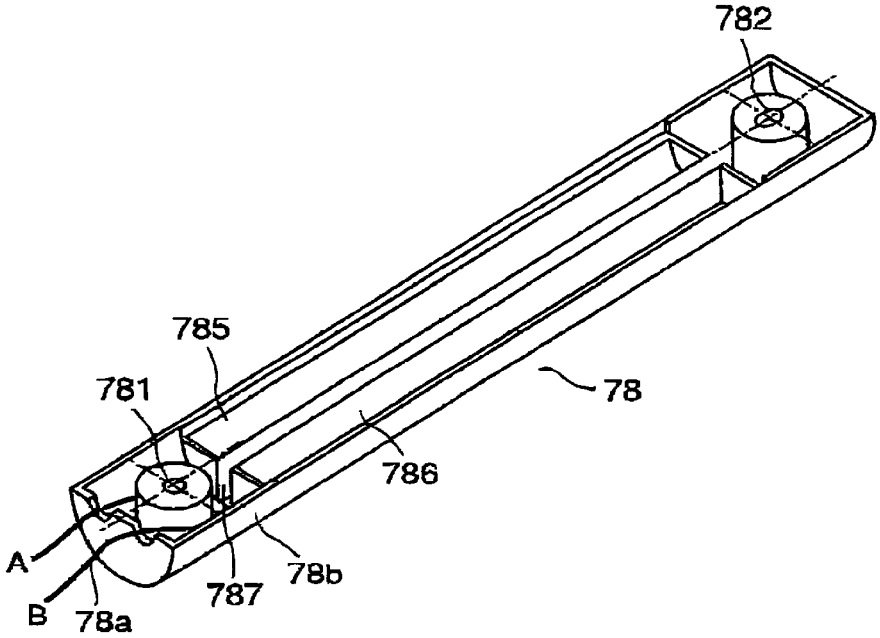
FIG. 4 is a perspective view of a coil unit.
Figure 5:
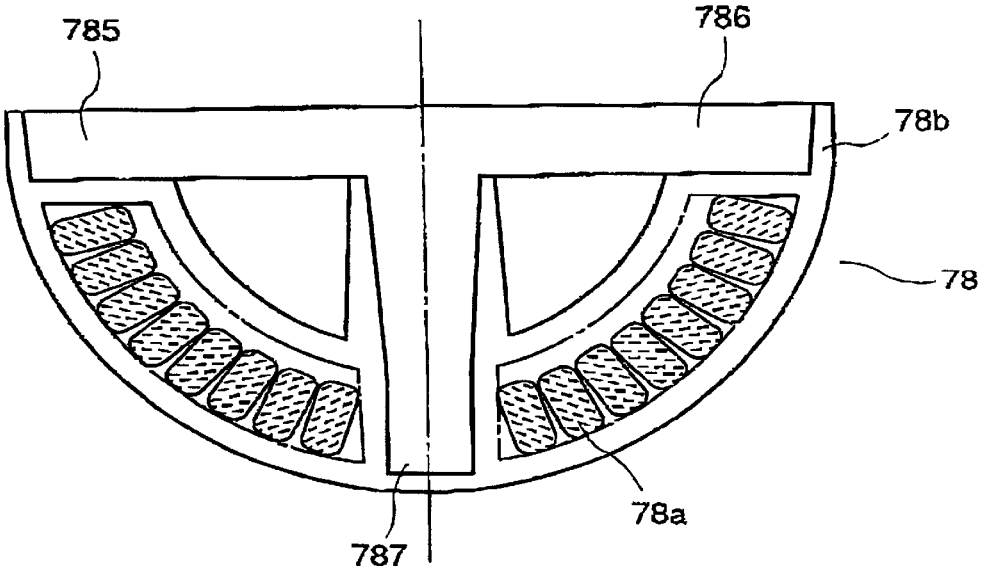
FIG. 5 is a sectional view of a coil unit.
Figure 6:
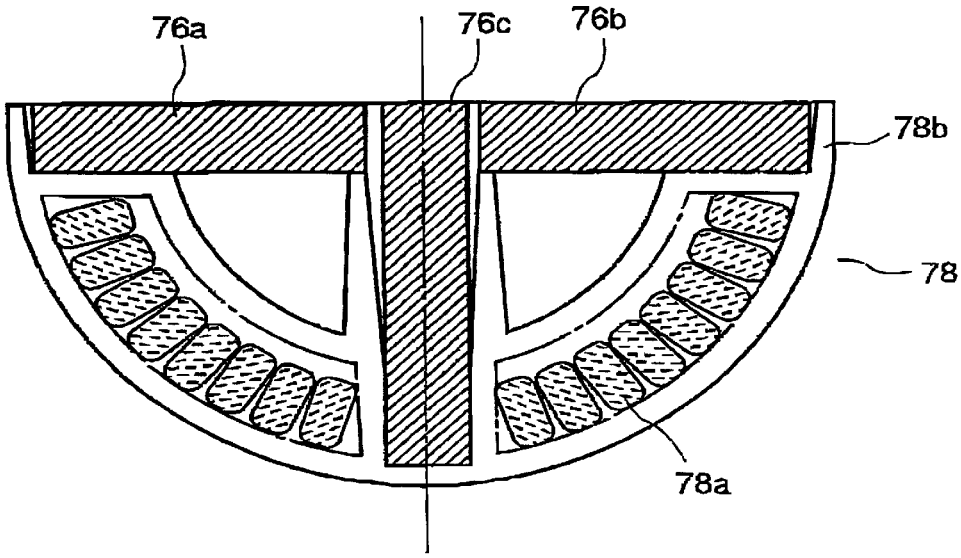
FIG. 6 illustrates a coil unit to which a magnetic member core is mounted.

An excitation coil 78*a* (first coil) is connected to a high frequency voltage source circuit 10 (high frequency voltage source circuit) to be supplied with high frequency electric power of 100 2000 kW. Therefore, the use is made with a Litz wire comprising several or hundred and several tens thin wires. The Litz wire is supported in the state shown in FIG. 3, and is unified with non-magnetic resin material (supporting member). The resin material is PPS, PBT, PET, LCP (liquid crystal polymer) or the like which are non-magnetic. FIG. 4 is a perspective view of a coil unit 78 integrally formed with the excitation coil 78*a*, and FIG. 5 is a sectional view thereof. The resin material-portion 78*b* of the coil unit 78 functions also as a holder for the magnetic member cores 76 (76*a*, 76*b*, 76*c*), and the magnetic member cores (magnetic member) are disposed at the respective positions 785, 786, 787.

The magnetic member core 76 is made of a material such as ferrite having a high magnetic permeability and exhibit low loss. In the case of alloy such as permalloy, a laminated structure may be employed in consideration of the fact that eddy current loss in the core is large at a high frequency. The core is used to raise the efficiency of the magnetic circuit and to block the magnetic field. The coil unit 8 is mounted on th stay 75, and therefore, is fixed to the fixing device.

The integral formation will be described. For supporting the excitation coil 78*a*, a supporting member 738 and a supporting member 789 are provided at the respective sides of the coil. The supporting member 788 is integral with the coil unit. First, the first supporting member 788 is mounted to one or the surfaces of the coil, and thereafter, the second supporting member 789 is press-contacted to the other side of the coil. Then, resin material liquid is poured into between the first supporting member and the second supporting member, and thereafter, the resin material is cooled down, by which the excitation coil 78*a* and the coil unit 78 are integrally molded. In this example, the integrally molded coil unit has been taken. However, the present invention is not limited to the integrally molded one, and another molding method is usable.

Figure 7:
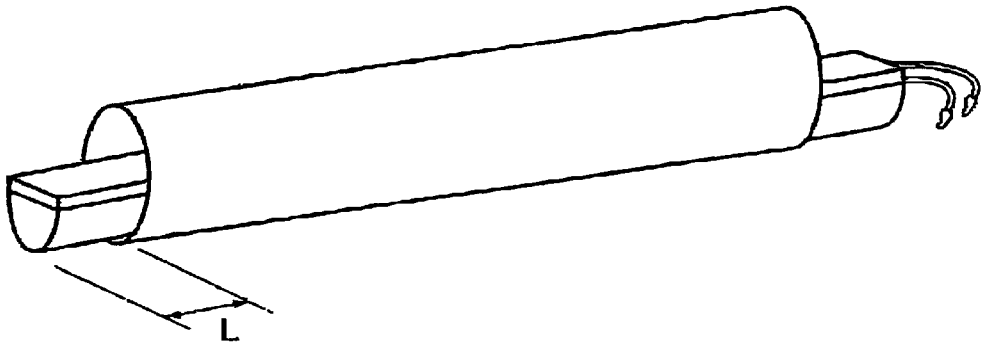
FIG. 7 illustrates a relation between the excitation coil unit and the fixing roller.

The coil unit 78 has a length larger than that of the fixing roller 71, and the opposite ends thereof is extended out and exposed out of the associated ends of the fixing roller 71 (FIG. 7). Referring to FIGS. 4 and 7 the first supporting member 88 supporting the excitation coil 78*a* is extended to the ends of the coil unit beyond the excitation coil 78*a*. The excitation coil 73*a* is shorter than the fixing roller 17. In this embodiment, the coil unit 78 is longer than the fixing roller 71. However, the length relation may be any if the excitation coil 78*a* is shorter than the fixing roller 71.

The preferred embodiments of the present invention will be described.

(Embodiment 1)

Figure 8:
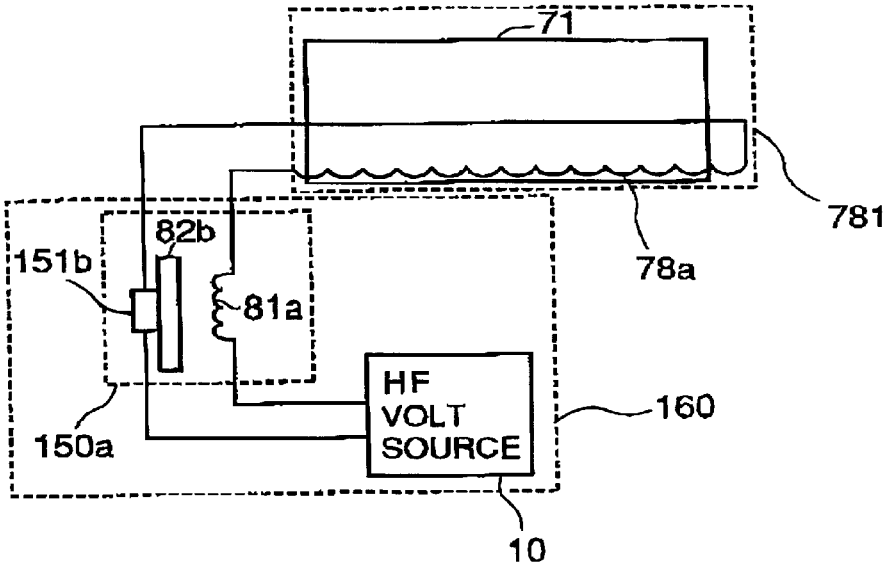
FIG. 8 is an equivalent circuit diagram of heating devices according to first and second embodiments of the present invention.

FIG. 8 is an equivalent circuit diagram of the heating device and the image forming apparatus according to a second embodiment.

The heating device and the image forming apparatus comprises a fixing roller 71 (first heating medium), a coil 78*a* (first coil 78*a*). The fixing roller 71 and the coil 78*a* constitutes a heating medium unit 781. They further comprises a high frequency voltage source circuit 10, temperature sensing portion 150*a*, a control unit 160 disposed at a position away from the heating medium unit 781, a second coil 51*a* disposed at a position away from the heating medium unit 781, a second heating mediums 82*a*, temperature fuse 151*a* which is a temperature sensor.

The description will be made as to an operation upon abnormality. The temperature sensing portion 150*a* is constituted by the second coil 81*a*, the second heating medium 82*a* and the temperature sensor 15*a,* wherein the second coil 81*a* is connected in series with the coil 78*a* (first coil). The number of turns of the coil will be described. The number of turns of the first coil 78*a* is 10 in this embodiment, and the number of number turns of the second coil 81*a* is three in this embodiment, c. It will suffice if the number of turns of the second coil is smaller than the number of turns of the first coil. The second heating medium 81*a* of steel, stainless steel or the like disposed adjacent the second coil 81*a* is heated by induced current produced by the magnetic field provided by the second coil 81*a*. When the current flows through the first coil and the second coil, the temperature of the second heating medium with which the number of turns of the coil thereon is smaller is lower than that of the temperature of the first heating medium. The temperature fuse 151*a* is closely contacted to the second heating medium 82*a*, and when the temperature of the temperature fuse 151*a* connected in series with the coil 78*a* reaches a predetermined level, the electric power supply is shut off. When the thermister (temperature detection member for the fixing roller 71) is insufficiently contacted to or is separated from the fixing roller, the abnormality of excessive current occurs. In the case that electric power is normally 800W, for example, the electric power becomes 1200 W, for example. When the steel is used in the fixing roller and the second heating medium 82*a*, the temperature of the fixing roller 71 reaches 240° C. upon abnormality, but the second heating medium is as low as 150° C. Therefore, the temperature fuse 151*a* is selected such that it is disconnected upon such a temperature. The shut-off temperature is different depending on the second heating medium 82*a* and the number of turns of the second coil 81*a*, and the temperature fuse is selected accordingly. In this embodiment, the temperature fuse is closely contacted to the second heating medium 2*a*. However, it may be out of contact from the second heating medium 82*a*.

With such a structure, the number of turns of the second coil 81*a* is reduced relative to the coil 78*a*, so that heat generation temperature of the second heating medium 82*a* is lowered the proportion to the fixing roller 71. The heat generation amount of the second coil 81*a* per se is smaller than the heat generation amount of the first coil 78*a* since the number of turns is smaller, so that influence to the second heating medium 92*a* is smaller. In this manner, the excessive temperature rise of the fixing roller 71 can be detected without erroneous detection of the excessive temperature rise of the fixing roller 71 which may occur when the temperature sensing member is disposed adjacent the fixing roller 71.

(Embodiment 2)

FIG. 8 is an equivalent circuit diagram of the heating device and the image forming apparatus according to a second embodiment.

The heating device and the image forming apparatus comprises a fixing roller 71 (first heating medium, a coil 78*a* (first coil 78*a*). The fixing roller 71 and the coil 78*a* constitutes a heating medium unit 781. They further comprises a high frequency voltage source circuit 10, temperature sensing portion 150*a*, a control unit 160 disposed at a position away from the heating medium unit 781, a second coil 81*a* disposed at a position away from the heating medium unit 781, a second heating mediums 82*a*, temperature fuse 151*b* which is a temperature sensor.

The operation upon abnormality is the same as with Embodiment 2. In this embodiment, the thermo-switch 151*b* is closely contacted to the second heating medium 82*a*, but they may be kept out of contact relative to each other.

The thermo-switch 151 is quite greatly influenced by the circumference temperature, similarly to the temperature fuse in Embodiment 2, and therefore, the disposition thereof is such that it is not influenced by the heat from the heating medium unit 781 and the first coil 78, by which the latitude of selections of the parts are greater. Since the number of turns of the second coil 81*a* is small, the heat generation amount of the second coil 81*a* is smaller than the heat generation amount of the first coil 73*a*, and therefore, the influence to the second heating medium 82*a* is smaller. In this manner, the excessive temperature rise of the fixing roller 71 can be correctly detected, without erroneous detection which may occur when the temperature sensing member is disposed adjacent the fixing roller 71. The use can be made with such a thermo-switch that even if it is actuated to becomes open states it automatically resets at a predetermined temperature when the cause of the actuation thereof is eliminated. By this, it is not necessary to replace or repair the temperature sensor 151*b*, the entire control unit 160 including the temperature sensor 151*b*, and therefore, the serviceability is improved.

(Embodiment 3)

Figure 11:
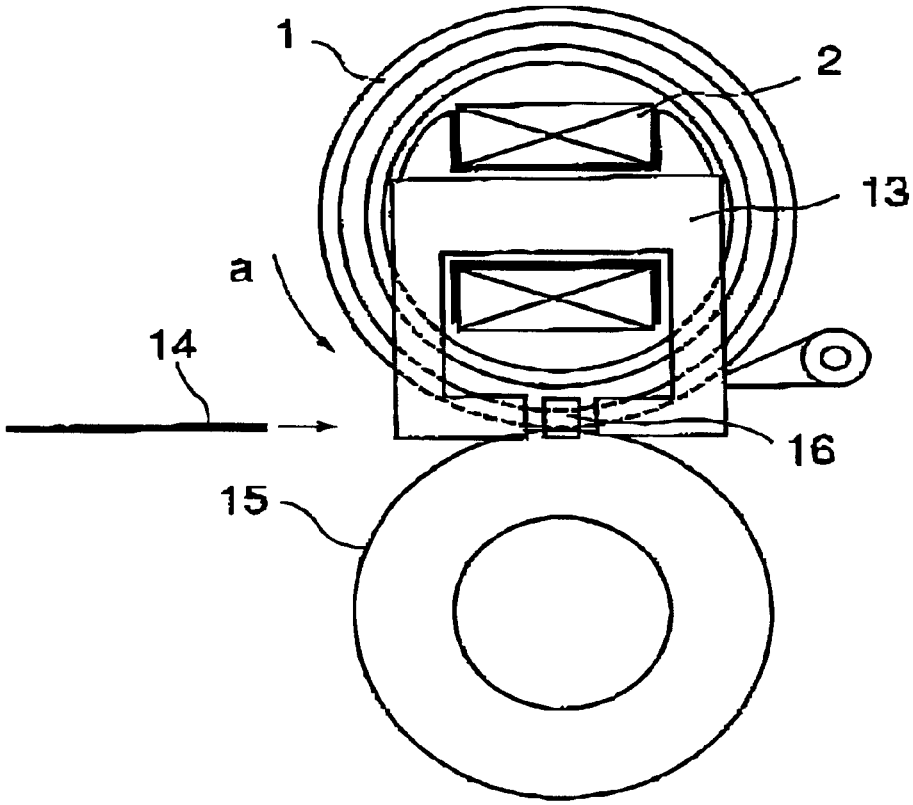
FIG. 11 is a front view of a conventional fixing device.

FIG. 11 is an equivalent circuit diagram of the heating device and the image forming apparatus according to a third embodiment.

The heating device and the image forming apparatus comprise a fixing roller 71 (first heating medium), a coil 78*a* (first coil 78*a*). The fixing roller 71 and the coil 78*a* constitute a heating medium unit 781. They further comprise a high frequency voltage source circuit 10, a temperature sensing portion 150*c*, a control unit 160 disposed at a position away from the heating medium unit 781, a second coil 61*a* disposed at a position away from the heating medium unit 781, a second heating medium 82*a* disposed at a position away from the heating medium unit 781, a fixing member temperature detecting element 73, a second heating medium temperature detecting element 153 (temperature sensing member), and a controller 12 (blocking means) for discriminating electric power supply to the coil from high frequency voltage source circuit 10. The controller 12 comprises a thermister 73 for detecting a surface temperature of the fixing roller 71 to determine the electric power supply to the first coil 73*a* from the high frequency voltage source circuit 10 in accordance with the output of the thermister 73. In this embodiment, when the temperature detected by the temperature detecting element 153 reaches a predetermined level, the controller 12 shuts off the electric power supply to the coil 78*a*.

The description will be made as to the operation upon abnormality. The temperature sensing portion 150*a* is constituted by the second coil ala, the second heating medium 82*a* and the temperature sensor 151*b*, wherein the second coil 81*a* is connected in series with the coil 78*a* (first coil). Here, as to the numbers of the turns of the coils, the number of the turns of the first coil 73*a* is 10, and the number of the turns or the second coil 81*a* is 3. It will suffice if the number of turns of the second coil is smaller than the number of turns of the first coil. The second heating medium 81*a* of steel, stainless steel or the like disposed adjacent the second coil ala is heated by induced current produced by the magnetic field provided by the second coil 81*a*. By doing so, when the current flows through both of the coils, the temperature of the second heating medium 82*a* is lower than that of the fixing roller 71. The temperature ruse 151*a* is closely contacted to the second heating medium 82*a*, and when the temperature of the temperature fuse 151*a* connected in series with the coil 78*a* reaches a predetermined level, the electric power supply is shut off. When the thermister (temperature detection member for the fixing roller 71) is insufficiently contacted to or is separated from the fixing roller, the abnormality of excessive current occurs. In the case that electric power is normally 800W for example, the electric power becomes 1200 W, for example. As a result, the temperature of the second heating medium 82*a* rises up to a predetermined temperature.

Thereafter, a signal indicative of the temperature detected by the temperature detecting element 153 is fed to the controller 12. When it is discriminated that output from the temperature detecting element 153 to the controller 12 indicates a temperature higher than the predetermined temperature, the electric power supply to the heating medium unit 781 is shut.

The following is a modification.

The temperature detecting element 153 is set at a maximum value of the heat generation temperature of the second heating medium 92*a*, and it is compared by the controller 120 with the temperature detected by the temperature detecting element 73 disposed contacted to or adjacent to the fixing roller 71. When the difference becomes a predetermined level, the operation of the high frequency voltage source circuit 10 is stopped. With such a control method, an erroneous detection of the temperature detection member 153 can be prevented to ensure the excessive temperature rise of the fixing roller 71.

(Embodiment 4)

Figure 12:
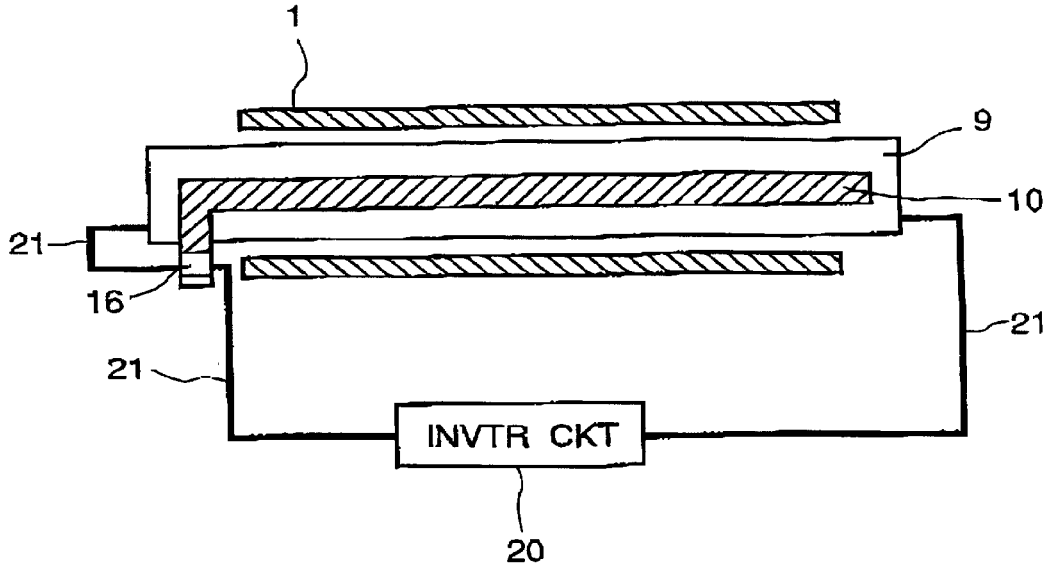
FIG. 12 is a side view of the conventional device.

FIG. 12 is an equivalent circuit diagram of the heating device and the image forming apparatus according to a fourth embodiment.

The heating device and the image forming apparatus comprises a fixing roller 71 (first heating medium), a coil 78*a* (first coil 78*a*). The fixing roller 71 and the coil 78*a* constitutes a heating medium unit 781. They further comprises a high frequency voltage source circuit 10, temperature sensing portion 150*b*, a control unit 160 disposed at a position away from the heating medium unit 781, a second coil 81*c* disposed at a position away from the heating medium unit 781, a second heating medium 32*c*, and a temperature sensor 151*c* (temperature sensing member).

In the first, second and third embodiments, the first coil and the second coil are electrically serially connected, but in this embodiment, the first coil and the second coil are connected electrically parallel.

The temperature sensing portion 150*c* comprises a second coil 81*c*, a second heating medium 82*c* and a temperature sensor 151*c*, wherein the second coil 81*c* is connected in parallel with the first coil (coil 78*a*). With this structure, the impedance of the second coil 81*c* is larger than that or the first coil 73*a* so that current through the second coil 81*c* is decreased. The second heating medium 82*c* of steel, stainless steel or the like disposed adjacent the second coil 81*c* is heated by induced current produced by the magnetic field provided by the second coil 81*c*. As a result, the magnetic flux density of the magnetic field generated by the second coil 81*c* is made smaller than the magnetic flux density generated by the first coil. Thus, the heat generation amount of the second heating medium 82*c* can be made smaller than that of the fixing roller 71. For example, the impedance of the first coil 78*a* is approx. 5 Ω, whereas the Impedance of the second coil 8, c is approx. 500 Ω. As a method for changing the impedance, there are a method in which the number of turns is changed, a method in which the diameter of the coil wire is changed, and so on, but any method is usable if the above-described relation of the impedances is satisfied. The number of the turns of the first coil 78*a* is 10 turns, and the number or the turns of the second coil 81*c* is 1000 turns, in this embodiment. The temperature sensor 151*c* is closely contacted to the second heating medium 32*c*, and functions to shut off the electric power supply when the temperature sensor 151*c* connected in series with the coil 73*a* detects the set temperature. For example, when a thermister as a temperature detection member for the fixing roller 71 becomes improperly contacted to the fixing roller or becomes apart therefrom, electric power of 1200W is supplied although the normal electric power is 800W. As a result, the temperature of the second heating medium 82C rises to the predetermined temperature, upon which the electric power supply to the first coil is shut off.

Thus, the current flowing to the second coil 81*c* is small, the heat generation amount of the first coil 73*a* is small, so that influence to the second heating medium 82*c* is small. In this manner, the excessive temperature rise of the fixing roller 71 can be correctly prevented without erroneous detection of the excessive temperature rise of the fixing roller 71 in the case that temperature sensing member is disposed adjacent the fixing roller 71. The temperature sensor may be a temperature fuse or thermo-switch as with the first or second embodiments. In the structure of this embodiment, the temperature sensor may be a thermister for detecting the second temperature, and the electric power supply may be controlled by the controller as with embodiment 3.

While the invention has been described with reference to the structures disclosed herein, it is not confined to the details set forth and this application is Intended to cover such modifications or changes as may come within the purpose of the improvements or the scope of the following claims.

What is claimed is:

1. An image recording apparatus comprising:

magnetic flux generating means for generating a magnetic flux;

a first heat generating member for generating heat by the magnetic flux generated by said magnetic flux generating means to fix an unfixed image on recording material by the generated heat;

a second heat generating member for generating heat by the magnetic flux generated by said magnetic flux generating means; and shut-off means for shutting off the electric power supply to said magnetic flux generating means in accordance with a temperature of said second heat generating member, wherein said shut-off means include a temperature detecting element for detecting a temperature of said second heat generating member, and shuts off electric power supply to said magnetic flux generating means in accordance with an output of said temperature detecting element, and wherein a temperature of said second heat generating member when the electric power is supplied is lower than that of said first heat generating member.

2. An apparatus according to claim 1, wherein said second heat generating member is disposed outside said first heat generating member.

3. An apparatus according to claim 1, further comprising a rotatable pressing member for press-contact with said first heat generating member to form a nip therebetween, wherein the magnetic flux generated by said magnetic flux generating means is effective to locally heat a neighborhood of the nip.

4. An apparatus according to claim 1, wherein said shut-off means includes a thermo-switch.

5. An apparatus according to claim 1, wherein said shut-off means includes a temperature fuse.

6. An apparatus according to claim 1, wherein said magnetic flux generating means includes a first coil and a second coil which are electrically connected with each other.

7. An apparatus according to claim 1, wherein said magnetic flux generating means includes a first coil for causing induction heating of said first heat generating member, and a second coil for causing induction heating of said second heat generating member wherein said first coil and said second coil are electrically connected in series, and a number of turns of said second coil is smaller than that of said first coil.

8. An apparatus according to claim 1, wherein said magnetic flux generating means includes a first coil for causing induction heating of said first heat generating member, and a second coil for causing induction heating of said second heat generating member wherein said first coil and said second coil are electrically connected in series, and said second coil has an impedance which is larger than that of said first coil.

9. An apparatus according to claim 1, wherein a temperature detecting element detects the temperature by contact with said second heat generating member.

10. An apparatus according to claim 2, wherein a temperature of said second heat generating member is lower than that of said first heat generating member.

11. An apparatus according to claim 3, wherein a temperature of said second heat generating member is lower than that of said first heat generating member.

* * * * *

UNITED STATES PATENT AND TRADEMARK OFFICE

CERTIFICATE OF CORRECTION

PATENT NO. : 6,782,216 B2
DATED : August 24, 2004
INVENTOR(S) : Hitoshi Suzuki

It is certified that error appears in the above-identified patent and that said Letters Patent is hereby corrected as shown below:

Column 1,
Line 30, "weans" should read -- means --; and "bolt" should read -- belt --.
Line 67, "a" should read -- the --.

Figure 9:
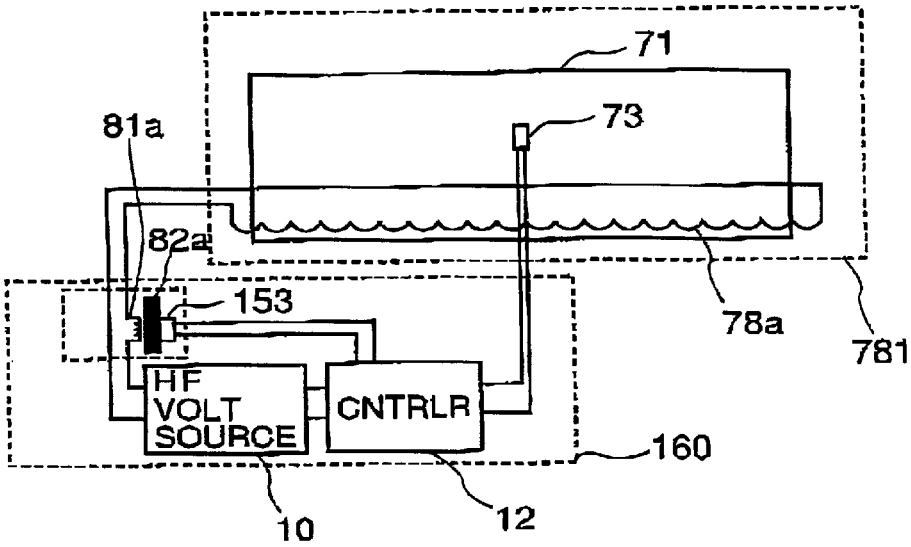
FIG. 9 is an equivalent circuit diagram of a heating device according to a third embodiment of the present invention.
Figure 10:
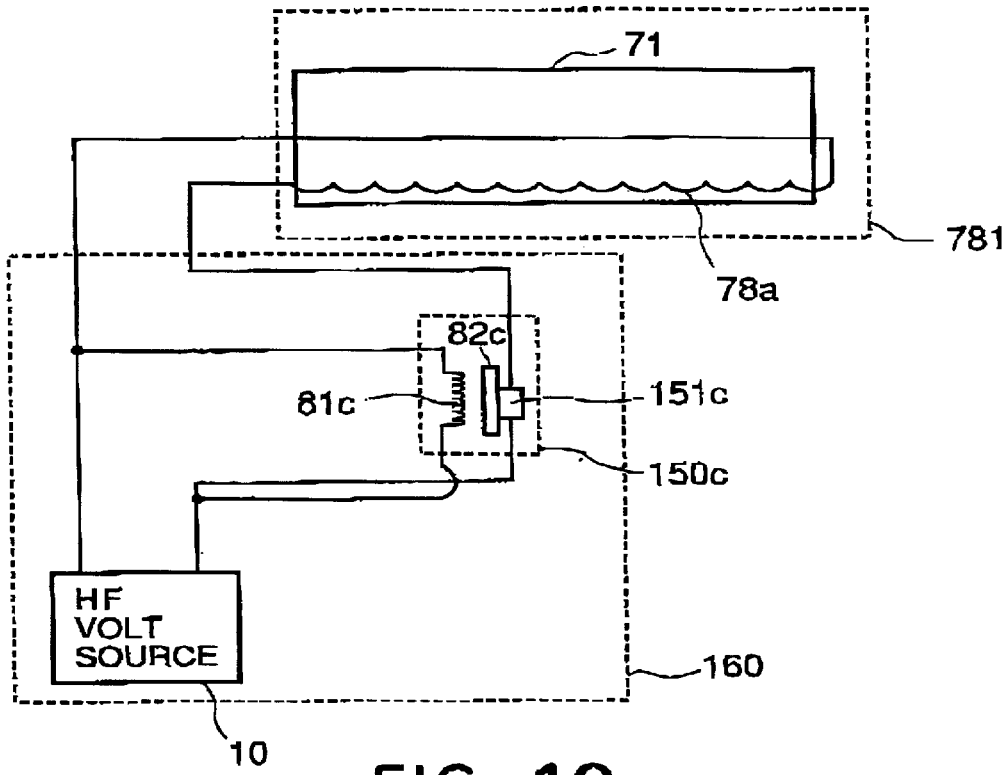

Column 2,
Line 13, "Inven-" should read -- inven- --.
Line 58, "FIG. 9" should be deleted.
Line 61, "device," should read -- device. --.
Line 65, "EMBODIMENT" should read -- EMBODIMENTS --.

Column 3,
Line 19, "arrow" should read -- arrow. --.
Line 40, "red" should read -- fed --.
Line 60, "PEA" should read -- PFA --.
Line 63, "rotatable" should read -- rotatably --.
Line 67, "(nip)," should read -- (nip). --.

Column 4,
Line 35, "th" should read -- the --.
Line 42, "or" should read -- of --.
Line 44, "into" should read -- in --.
Line 53, "is" should read -- are --.

Column 5,
Line 5, "prises" should read -- prise --.
Line 8, "51a" should read -- 81a --.
Line 9, "mediums" should read -- medium --.
Line 18, "number turns" should read -- turns --.
Line 19, "embodiment," should read -- embodiment. --; and "c." should be deleted.
Line 27, "thereon" should read -- thereof --.
Line 47, "2a." should read -- 82a. --.
Line 52, "lowered the" should read -- lowered in --.

Column 6,
Line 3, "prises" should read -- prise --.
Line 7, "mediums" should read -- medium --.
Line 28, "becomes" should read -- become --; and "states" should read -- state, --.
Line 45, "61a" should read -- 81a --.
Line 63, "ala," should read -- 81a, --.

UNITED STATES PATENT AND TRADEMARK OFFICE

CERTIFICATE OF CORRECTION

PATENT NO. : 6,782,216 B2
DATED : August 24, 2004
INVENTOR(S) : Hitoshi Suzuki

It is certified that error appears in the above-identified patent and that said Letters Patent is hereby corrected as shown below:

Column 7,
Line 1, "or" should read -- of --.
Line 5, "ala" should read -- 81a --.
Line 9, "ruse" should read -- fuse --.
Line 17, "800 W" should read -- 800 W, --.
Line 31, "92a," should read -- 82a, --.
Line 48, "prises" should read -- prise --.
Line 62, "or" should read -- of --.

Column 8,
Line 6, "Impedance" should read -- impedance --.
Line 7, "8, c" should read -- 81c --.
Line 12, "or" should read of --.
Line 40, "Intended" should read -- intended --.
Line 59, "include" should read -- includes --.

Signed and Sealed this

Twenty-third Day of November, 2004

JON W. DUDAS
*Director of the United States Patent and Trademark Office*